US005103945A

United States Patent [19]

Kaneko

[11] Patent Number: 5,103,945

[45] Date of Patent: Apr. 14, 1992

[54] COLLAPSIBLE LUGGAGE

[75] Inventor: Katsukichi Kaneko, Tokyo, Japan

[73] Assignee: Maruwa Echo Co., Ltd., Japan

[21] Appl. No.: 656,577

[22] Filed: Feb. 15, 1991

Related U.S. Application Data

[63] Continuation-in-part of Ser. No. 589,679, Sep. 28, 1990, abandoned.

[30] Foreign Application Priority Data

Jan. 25, 1990 [JP] Japan ..... 2-5054

[51] Int. Cl.[5] ..... B45C 7/00; B45C 13/04

[52] U.S. Cl. ..... 190/107; 190/127

[58] Field of Search ..... 190/14, 21, 103, 107, 190/125, 127; 150/130

[56] References Cited

U.S. PATENT DOCUMENTS

| | | | |
|---|---|---|---|
| 1,273,875 | 7/1918 | Kosta | 190/103 X |
| 1,387,597 | 8/1921 | Fetters | 190/127 X |
| 1,513,909 | 11/1924 | Hunter | 190/103 |
| 1,636,838 | 7/1927 | Roser | 190/103 |
| 2,538,616 | 1/1951 | Cross | 190/107 |
| 2,774,450 | 12/1956 | Shallberg | 190/127 |
| 4,588,056 | 5/1986 | Bernbaum | 190/107 |
| 4,655,329 | 4/1987 | Kaneko | 190/107 |

FOREIGN PATENT DOCUMENTS

| | | | |
|---|---|---|---|
| 1069164 | 7/1954 | France | 190/107 |
| 1315104 | 12/1962 | France | 190/107 |
| 727879 | 4/1955 | United Kingdom | 190/107 |
| 2184940 | 7/1987 | United Kingdom | 190/107 |

*Primary Examiner*—Sue A. Weaver

*Attorney, Agent, or Firm*—Eckert Seamans Cherin & Mellott

[57] ABSTRACT

Luggage for transporting articles is collapsible into a compact size by simple handling. The luggage includes a ceiling board, a bottom board, two flexible side faces which interconnect the ceiling and the bottom boards, and flexible front and rear faces enclosing front and rear portions of the luggage. Reinforcing inserts are attached to insert retaining hinges inside the luggage. The reinforcing inserts are hingedly movable between a first position wherein the reinforcing inserts are positioned upright along the side faces and the luggage is in an operative position, and a second position wherein the reinforcing inserts are positioned flat along the bottom board and the luggage can be collapsed.

5 Claims, 3 Drawing Sheets

COLLAPSIBLE LUGGAGE

CROSS REFERENCE TO RELATED APPLICATION

This application is a continuation-in-part of application Ser. No. 589,679 filed Sept. 28, 1990 now abandoned.

BACKGROUND OF THE INVENTION

1. Field of the Invention

The invention relates to the field of luggage for transporting articles, and more particularly, to collapsible luggage which is capable of being folded into a compact size by simple handling.

2. Prior Art

Applicant is the inventor of collapsible luggage disclosed in U.S. Pat. No. 4,655,329 which is incorporated herein by reference. That invention relates to luggage which includes a ceiling board having a handle, a bottom board, front and rear faces, and two side walls which are formed of freely foldable sheet material. Each of the side walls has a pocket attached at an inner lower portion, and fastening means attached at an inner upper portion. Side reinforcing inserts are insertable in the pockets and are removably held adjacent the side walls by the fastening means.

A problem with the prior art luggage is that each time the luggage is expanded the reinforcing inserts must be inserted in the pockets, and each time the luggage is collapsed the reinforcing inserts must be removed from the pockets. The insertion and removal of the reinforcing inserts is inconvenient and time-consuming. This problem is especially acute in the case where hook and loop (Velcro) fasteners are attached to insides of the pockets for retaining the reinforcing inserts more securely. Additionally, since the reinforcing inserts must be completely removed from the pockets in order to collapse the luggage, the reinforcing inserts may become separated from the luggage, misplaced and possibly lost. There is a need for collapsible luggage having reinforcing inserts which are detachably connected to the luggage, and which are pivotally movable between a first position wherein the luggage is operative and a second position wherein the luggage is collapsed, without detaching the inserts from the luggage.

SUMMARY OF THE INVENTION

It is an object of the invention to provide collapsible luggage which is simple and easy to use.

It is another object of the invention to provide collapsible luggage having reinforcing inserts which need not be detached from the luggage in order to collapse it.

It is a further object of the invention to provide collapsible luggage having reinforcing inserts which are displaceable for collapsing the luggage while remaining attached to the luggage.

These and other objects are accomplished by luggage comprising a ceiling board, a bottom board, a front face, a rear face, and two flexible side faces which interconnect the ceiling board and the bottom board. An insert retaining hinge is located at both intersections of the bottom board and the flexible side faces. The insert retaining hinges have first fastening means on one side thereof. A pair of reinforcing inserts having second fastening means at lower ends thereof are detachably connected to the insert retaining hinges by engagement of the first and second fastening means. The reinforcing inserts are pivotally movable between a first position wherein the luggage is in an operative condition, and a second position wherein the luggage is able to be collapsed, without detaching the inserts from the luggage. Third fastening means are provided at an upper end of the reinforcing inserts. Fourth fastening means are pivotally mounted adjacent both intersections of the two side faces and the ceiling board. Fifth fastening means are attached at both ends of the ceiling board. The fourth fastening means is movable between a first position wherein it engages with the fifth fastening means for securing the fourth fastening means out of the way when folding up the luggage, and a second position wherein it engages with the third fastening means for retaining the reinforcing inserts along the two side faces to form the luggage into an operative shape.

DETAILED DESCRIPTION OF THE PREFERRED EMBODIMENTS

Figure 3:
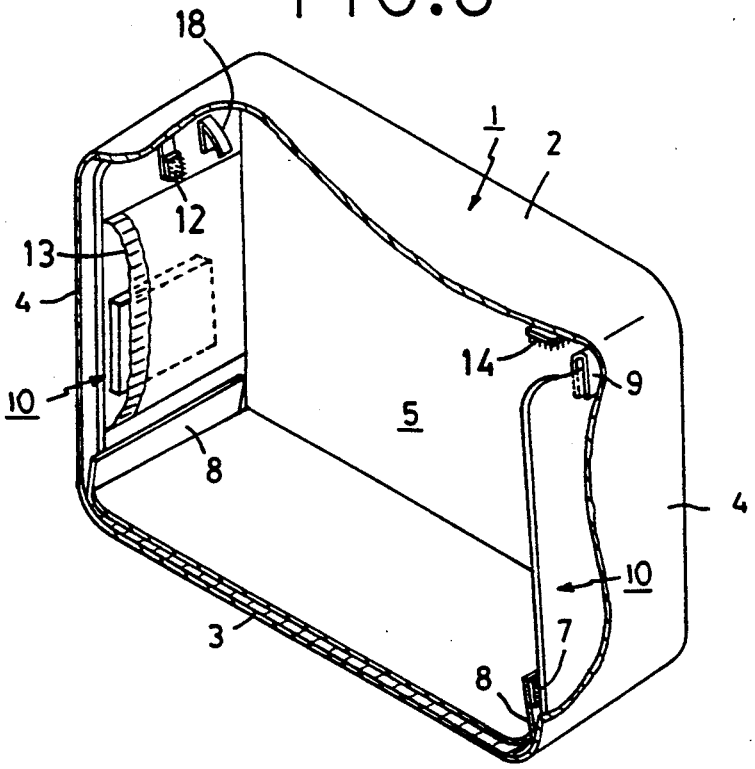
FIG. 3 is a perspective cutaway view illustrating the reinforcing inserts in a first position inside the luggage according to the invention, wherein the luggage is operative.
Figure 4:
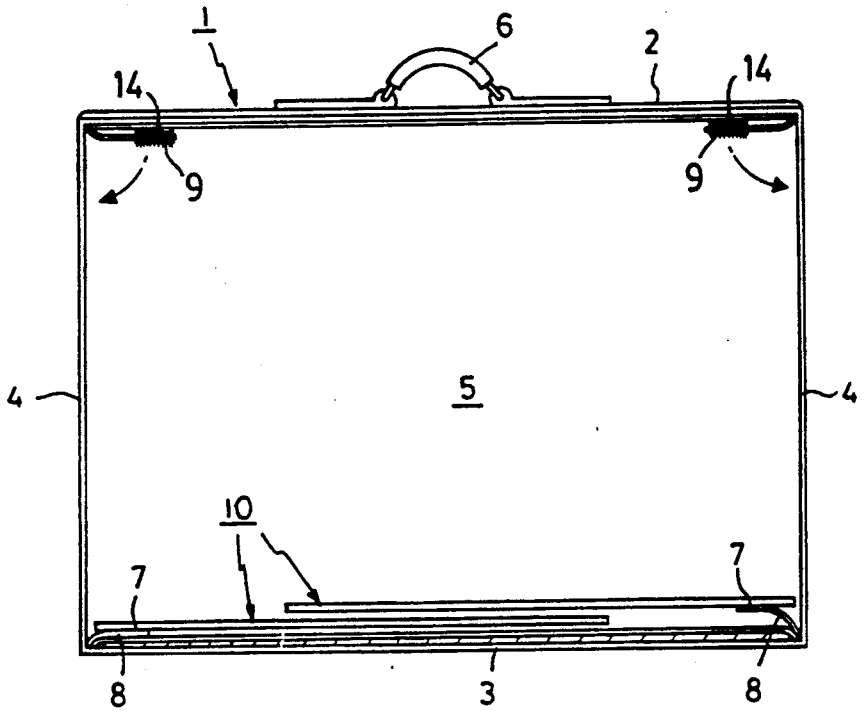
FIG. 4 is a vertical sectional view illustrating the reinforcing inserts in a second position inside the luggage according to the invention, wherein the luggage is ready for collapse.

A piece of luggage according to the invention is shown generally as 1 in FIGS. 1–5. The piece of luggage 1 has a ceiling board 2, a bottom board 3, two flexible side faces 4 which interconnect the ceiling board and the bottom board. Opposite facing sides of the two flexible side faces define front and rear faces 5. The front and rear faces 5 are composed of flexible sheet. The ceiling board may be provided with a handle 6, as shown in FIG. 4. In a preferred embodiment, a reinforcing board 15 and a bottom cover 16 are superposed in order on the bottom board 3. An insert retaining hinge 8 is located at both intersections of the bottom board 3 and the flexible side faces 4. The insert retaining hinges 8 are preferably made from a strip of flexible material and are provided with first fastening means 7 on a side thereof adjacent the flexible side faces 4.

Figure 1:
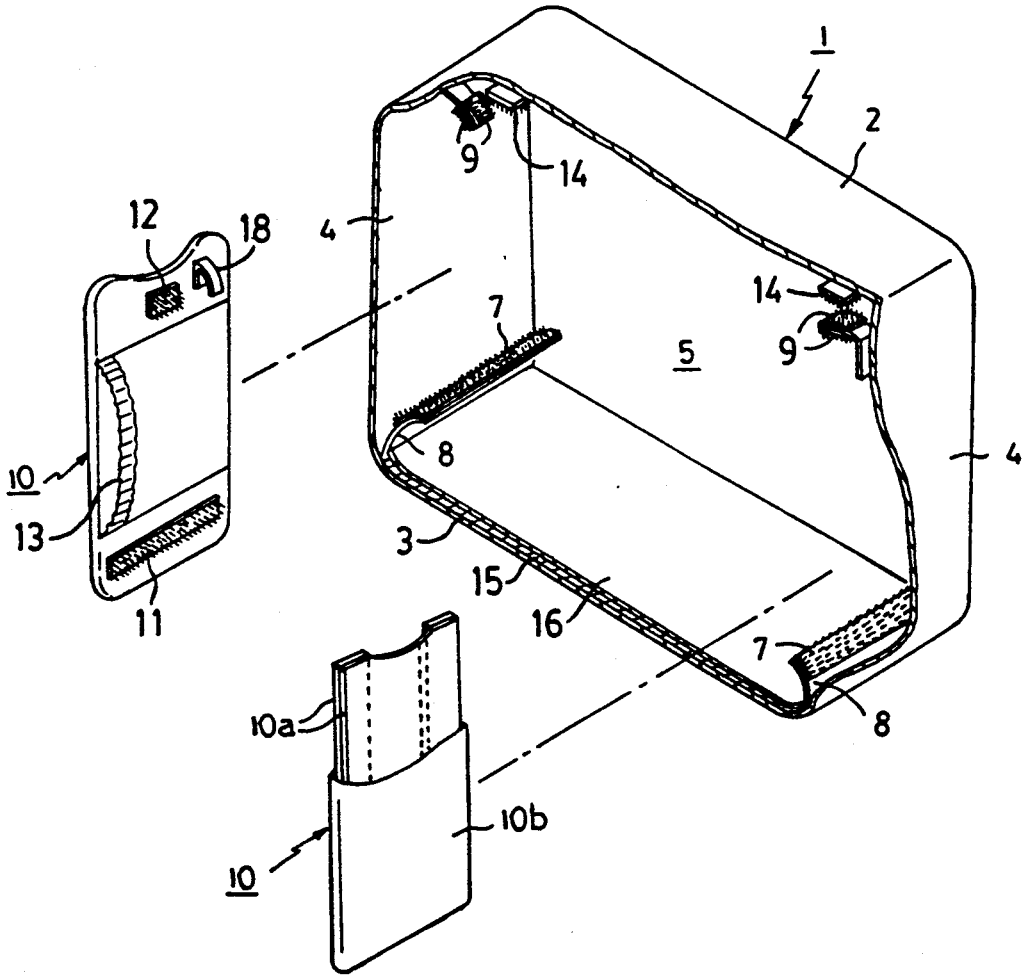
FIG. 1 is a perspective view illustrating component parts of the luggage according to the invention.
Figure 2:
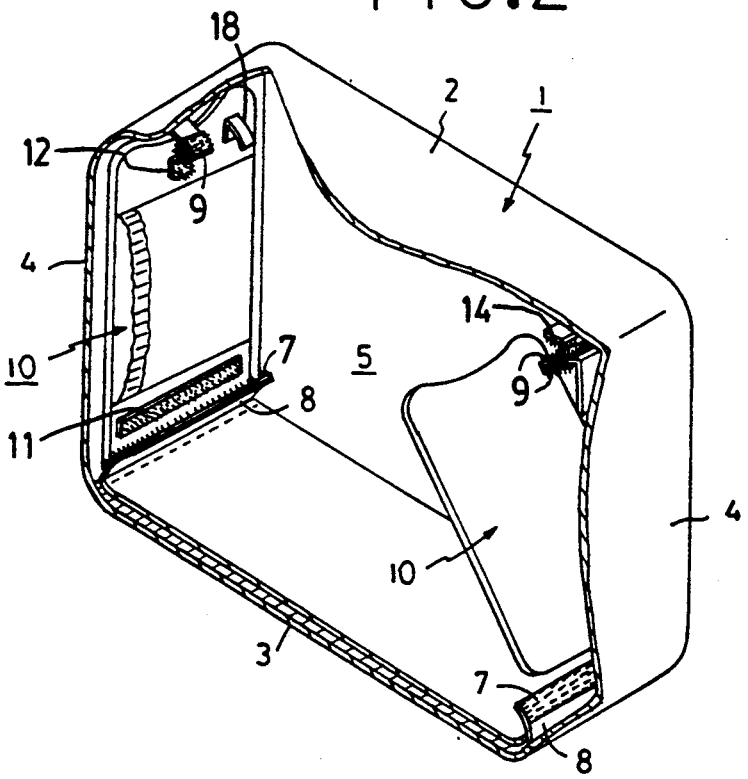
FIG. 2 is a perspective cutaway view illustrating attachment of reinforcing inserts within the luggage according to the invention.
Figure 5:
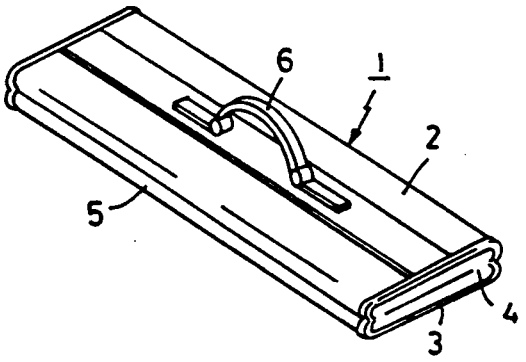
FIG. 5 is a perspective view illustrating the luggage in a collapsed position.

Reinforcing inserts 10 are provided for maintaining the luggage in an operative condition. The reinforcing inserts 10 are essentially rigid and may be constructed from an essentially rigid inner board **10*a* within a flexible outer covering 10*b*, as shown in FIG. 1. The reinforcing inserts 10 may include a pouch 13 which is capable of receiving small articles, and may also include a knob 18 for grasping to permit easier manipulation of the reinforcing inserts. Second fastening means 11 is provided at a lower end of the reinforcing inserts 10 for detachably engaging with the first fastening means 7 on the insert retaining hinges 8. The insert retaining hinges 8 permit the reinforcing inserts 10 to be pivotally moved between a first position wherein the reinforcing inserts 10 are positioned upright along the side faces 4 and the luggage is in an operative condition as shown in FIG. 3, and a second position wherein the reinforcing inserts 10 are positioned flat along the bottom board 3 prior to collapsing the luggage, as shown in FIG. 4. When the reinforcing inserts 10 are positioned flat along the bottom board 3, the luggage may be collapsed into a compact size by folding the flexible side faces 4 and the flexible front and rear faces 5, as shown in FIG. 5**.

Third fastening means 12 are provided at an upper end of the reinforcing inserts 10. Fourth fastening means 9 are pivotally mounted adjacent both intersections of the two side faces 4 and the ceiling board 2. Fifth fastening means 14 are attached at both ends of the ceiling board 2. The fourth fastening means 9 is movable between a first position engaged with the fifth fastening means 14 for securing the fourth fastening means out of the way when collapsing the luggage, and a second position engaged with the third fastening means 12 for securing the reinforcing inserts 10 in an upright position along the side faces 4 of the luggage. Upper central parts of the reinforcing inserts 10 have a concave shape to provide clearance for engaging the third and fourth fastening means.

Each of the first through fifth fastening means preferably comprises appropriate mating parts of hook and loop fasteners, although other known fasteners such as snaps, pins, buttons, or the like may be used.

The luggage according to the invention has the advantage that the reinforcing inserts 10 need not be detached from the luggage in order to collapse it. The reinforcing inserts may remain attached to the insert retaining hinges 8 during collapse. The reinforcing inserts 10 are pivotally movable between an upright position and a horizontal position within the luggage. In the upright position, the reinforcing inserts are positioned along the side faces 4 and the luggage is in the operative shape. In the horizontal position, the reinforcing inserts are positioned flat along the bottom board 3, and the luggage may be collapsed by folding the flexible side faces 4 and the flexible front and rear faces 5. The luggage can be simply and easily collapsed to a compact size to minimize its volume for storing it. The reinforcing inserts remain attached inside the collapsed luggage so they will not be lost. The luggage is easily expanded to the operative shape by pivotally moving the reinforcing inserts to the upright position.

I claim:

1. Luggage comprising:

a ceiling board;

a bottom board;

two flexible side faces, each side face interconnecting the ceiling board and the bottom board, opposite facing sides of said two flexible side faces defining a front face and a rear face;

an insert retaining hinge located at each intersection of the bottom board and the two side faces, the insert retaining hinges having first fastening means;

a reinforcing insert having second fastening means at a lower part and removably attached to each of the insert retaining hinges by engagement of the second fastening means with the first fastening means, whereby the reinforcing inserts are pivotally movable between a first position wherein the reinforcing inserts are positioned upright along the flexible side faces and the luggage is in an operative shape, and a second position wherein the reinforcing inserts are positioned flat along the bottom board to enable collapse of the luggage;

third fastening means located at an upper part of each of the reinforcing inserts;

fourth fastening means pivotally mounted adjacent both intersections of the ceiling board and the two side faces; and fifth fastening means located at both ends of the ceiling board adjacent to the fourth fastening means, the fourth fastening means being positionable in two positions, a first position engaged with the fifth fastening means for securing the fourth fastening means out of the way when collapsing the luggage, and a second position engaged with the third fastening means for retaining the reinforcing inserts along the two side faces to form the luggage into the operative shape.

2. The luggage according to claim 1, wherein the insert retaining hinges are made of a flexible material.

3. The luggage according to claim 1, wherein at least one of the first through fifth fastening means is a hook and loop fastener.

4. The luggage according to claim 1, further comprising a knob attached to the upper part of each of the reinforcing inserts.

5. The luggage according to claim 1, further comprising a handle attached to an outer surface of the ceiling board.

* * * * *